US008939472B2

(12) United States Patent
Bradway

(10) Patent No.: US 8,939,472 B2
(45) Date of Patent: Jan. 27, 2015

(54) LATCHING ASSEMBLY FOR AN INK PRINTHEAD

(75) Inventor: Jeffrey John Bradway, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 799 days.

(21) Appl. No.: 13/091,658

(22) Filed: Apr. 21, 2011

(65) Prior Publication Data

US 2012/0269565 A1 Oct. 25, 2012

(51) Int. Cl.

| | |
|---|---|
| ***E05C 5/04*** | (2006.01) |
| ***B41J 25/34*** | (2006.01) |
| ***B41J 2/175*** | (2006.01) |
| *E05C 5/02* | (2006.01) |

(52) U.S. Cl.

CPC ..... *B41J 25/34* (2013.01); *B41J 2/17593* (2013.01); *Y10S 292/04* (2013.01); *Y10S 292/37* (2013.01)

USPC ..... 292/61; 292/58; 292/62; 292/DIG. 4; 292/DIG. 37; 347/40

(58) Field of Classification Search

USPC ..... 292/1, 57–61, 63–65, 67, 68, 70, 71, 292/DIG. 4, DIG. 37, 4, 62; 70/360, 361, 70/387, DIG. 20, DIG. 78, DIG. 79; 347/49, 347/40, 44, 67, 197, 198, 22, 238, 242, 245, 347/257, 263

See application file for complete search history.

(56) References Cited

U.S. PATENT DOCUMENTS

| | | | | | |
|---|---|---|---|---|---|
| 701,238 | A * | 5/1902 | Williams | 292/61 |
| 1,907,625 | A * | 5/1933 | Vogt | 70/100 |
| 3,152,822 | A * | 10/1964 | Griffiths | 292/61 |
| 3,288,115 | A * | 11/1966 | Hechtle | 401/110 |
| 3,291,101 | A * | 12/1966 | Helitas | 401/110 |
| 3,318,289 | A * | 5/1967 | Marynissen | 401/110 |
| 3,402,379 | A * | 9/1968 | Amis, Jr. et al. | 439/155 |
| 3,819,282 | A | 6/1974 | Schultz | |
| 3,862,773 | A * | 1/1975 | Bisbing | 292/70 |
| 4,113,221 | A * | 9/1978 | Wehner | 248/408 |
| 4,165,854 | A * | 8/1979 | Duly | 248/408 |
| 6,516,643 | B1 * | 2/2003 | Olshausen | 70/337 |
| 6,536,592 | B1 * | 3/2003 | Chang et al. | 206/459.1 |
| 7,578,578 | B2 * | 8/2009 | Akahane | 347/49 |
| 7,712,343 | B2 * | 5/2010 | Smith et al. | 70/467 |
| 8,403,458 | B2 * | 3/2013 | Montfort et al. | 347/40 |
| 2007/0113607 | A1 * | 5/2007 | Huang | 70/432 |

* cited by examiner

*Primary Examiner* — Kristina Fulton

*Assistant Examiner* — Alyson M Merlino

(74) *Attorney, Agent, or Firm* — Maginot Moore & Beck LLP

(57) ABSTRACT

A latching assembly for mounting a printhead to a plate assembly of a printing machine comprises a barrel attached to the printhead and an actuator member having an actuator head disposed for translation and rotation relative to the barrel and a latch element with a circumferential element configured to engage a catch surface on the plate assembly upon rotation of the actuator member. A ratchet mechanism between the actuator head and the barrel is configured to hold the actuator head at different longitudinal positions relative to the barrel upon rotation of the actuator head. A push button is carried by the barrel and a cam mechanism is defined between the push button and the actuator member that is configured to rotate the actuator member relative to the barrel when the proximal face of the push button is manually depressed. As the push button is successively pushed the circumferential element successively engages the catch surface.

21 Claims, 13 Drawing Sheets

LATCHING ASSEMBLY FOR AN INK PRINTHEAD

TECHNICAL FIELD

The present invention relates to image producing or printing machines, and more specifically to the mounting of printheads in such machines.

BACKGROUND

Referring to FIG. 1, a printhead assembly 230 for a high-speed, or high throughput, multicolor image producing or printing machine is shown. The assembly 230 is coupled to a controller 200 configured to control the operation of the printhead assembly and more particularly to direct the printheads of the assembly to produce an image from captured image data. For certain machines, the controller 200 may also control at least one actuator 220 that is operable to move the printhead relative to the substrate receiving the image. The assembly 230 shown in FIG. 1 includes two printheads 232 and 236, each having a corresponding front face 233, 237 and nozzle array 243, 245 for ejecting ink onto the substrate to form an image. It can be appreciated that an imaging or printing machine may include more than one printhead assembly 230 and more than the two printheads shown in FIG. 1. Although a solid-ink printhead is depicted in the drawings, it is understood that other type of printhead and printing or imaging systems are contemplated. In addition, a partial width printhead is shown, but other printheads, including full-width and reciprocating array printheads are contemplated.

Each printhead 232, 236 is rigidly mounted to a carrier plate or ball plate assembly 260 that may itself be rigidly mounted to a translation carriage controlled by the actuator 220. Thus, in a typical installation, the printheads are mounted to the carrier plate assembly by a plurality of fasteners 250. One such arrangement is shown in FIGS. 2-3. The printhead 232 is shown mounted to a carrier plate assembly 260 in FIG. 2 by a screw-type fastener 250. It can be appreciated that certain locating features may be incorporated between the printhead and carrier plate assembly in order to initially align the printhead. As shown in more detail in FIG. 3, the fastener 250 includes a shank 252 terminating in a threaded tip 254 configured to thread into an internally threaded boss 262. The head 256 of the fastener may incorporate a hex-feature for engagement with a driving tool to rotate the fastener/screw 250. A spring 258 is mounted between an enlarged portion 257 of the head 256 and a mounting flange 239 of the printhead. A snap-ring may be used to capture the fastener on the mounting flange 239. As the fastener is tightened into the threaded boss 262 of the carrier plate assembly 260 the spring bears against the mounting flange 239 to press the printhead 232 against the carrier plate assembly to form a fluid-tight seal (FIG. 4).

It is important that the printhead be properly engaged with the carrier plate assembly or ball plate to provide a fluid-tight engagement and to ensure that the printhead is correctly registered with the image-receiving substrate. When the printheads are replaced, care must be taken that the fasteners 250 are adequately and properly tightened to produce this proper engagement. Thus, in one procedure, each printhead 232, 236 is mounted using two fasteners 250, as shown in FIG. 1. To ensure proper seating of the printhead, the fasteners or screws 250 are tightened in alternating fashion until each screw is seated. The mating threads 254 typically have a fine pitch so multiple rotations of each fastener 250 is required to fully tighten each screw and seat the printhead. In order to ensure proper seating, the installation procedure typically requires making two full turns on one fastener, two full turns of the other fastener, and then repeating this sequence a second time to seat the printhead.

It can be appreciated that engaging the head 256 of each fastener in alternating fashion with a driving tool can be cumbersome and time consuming. Since the typical procedure requires a precise number of screw rotations for each step, it is not well-suited for use of a power driving tool. Thus, the driving tool must be a manual tool, such as a hex wrench, which can lead to user fatigue when replacing several printheads at one time, as frequently occurs. Moreover, unless a torque wrench is used there is always the risk that a customer will over-tighten a fastener which can lead to stripping of the threads or even fracture of the boss 262. It is desirable to provide a mechanism for mounting printheads to carrier plate or ball plate assemblies that is easier and more convenient to operate.

SUMMARY

In accordance with one aspect, a latching assembly is provided for mounting a printhead to a plate assembly in a printing machine. The latching assembly is provided with a hollow barrel that is attached, mounted or affixed to the printhead. An actuator member is rotatably and slidably disposed within the barrel and includes an actuator head and a latch element at a distal end configured to engage a catch surface on the plate assembly. A ratchet mechanism is provided between the actuator head and the barrel configured to advance the actuator head to discrete positions within the barrel upon rotation of the actuator member. In one aspect the ratchet mechanism includes at least two graduated surfaces and an indexing element slidably engaging the graduated surfaces as the actuator member rotates.

The latching assembly further comprises a push button disposed for translation within the barrel and configured to be manually depressed. A cam mechanism between the push button and the actuator mead is configured to rotate the actuator member relative to the barrel when the push button is depressed. The cam mechanism thus advances the actuator member to the discrete positions each time the push button is depressed. With each advancement of the actuator member the latch element increasingly engages the catch surface on the plate assembly, drawing the printhead successively into a fluid-tight engagement with the plate assembly. In one aspect, a force transmission member, such as a spring, is disposed between the actuator head and a surface of the printhead to apply a clamping force to the printhead.

DETAILED DESCRIPTION

For a general understanding of the environment for the devices and methods disclosed herein, as well as details thereof, reference is made to the drawings. As used herein, the words "printer", "printing machine" or "imaging machine" encompass any apparatus or machine that performs a print outputting function for any purpose, such as a digital copier, bookmaking machine, facsimile machine, multi-function machine, or the like.

Figure 1:
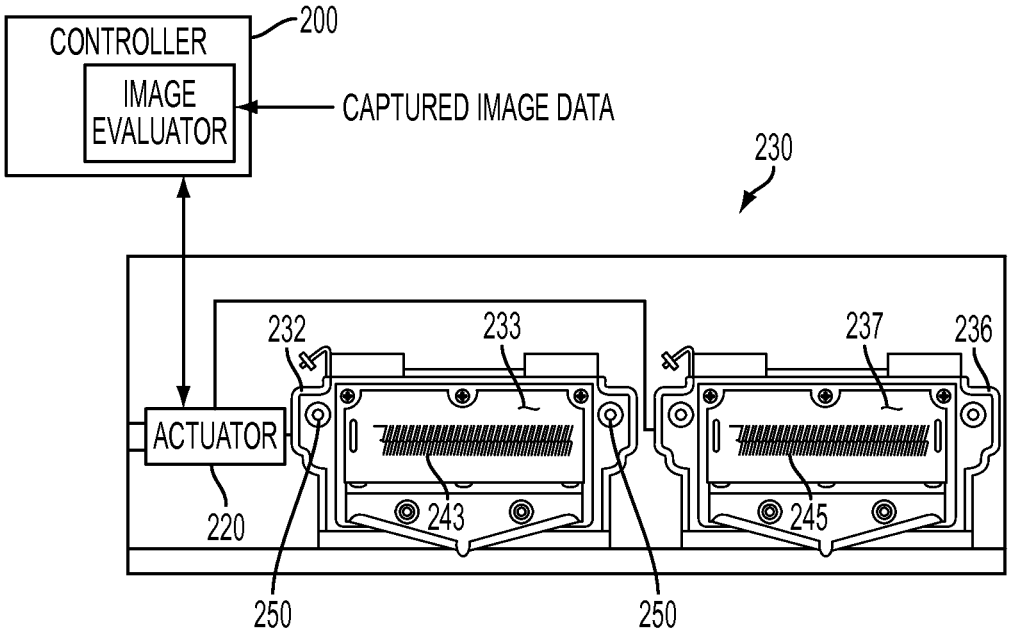
FIG. 1 is a diagram of a printhead assembly having two printheads.
Figure 2:
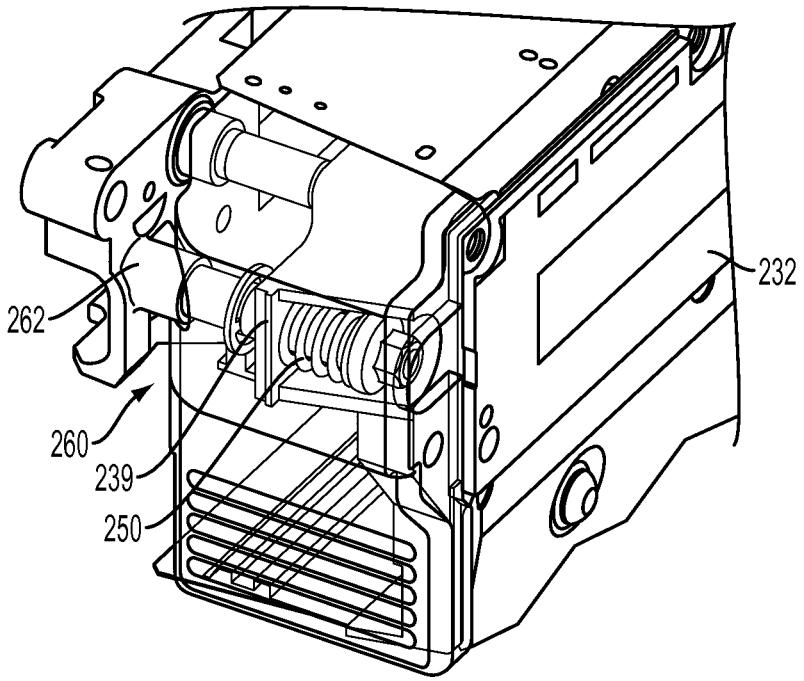
FIG. 2 PRIOR ART
FIG. 2 is a perspective view of a printhead mounted to a carriage plate assembly using a latching assembly of the prior art.
Figure 3:
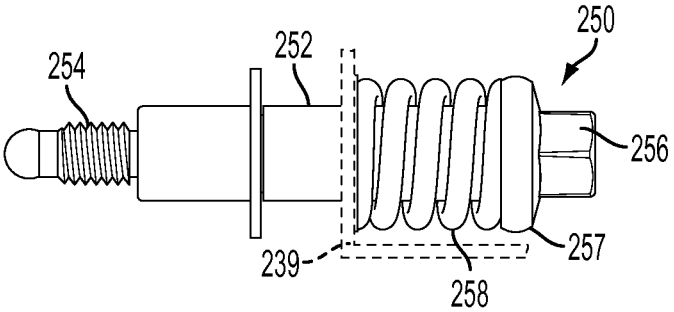
FIG. 3 PRIOR ART
FIG. 3 is an enlarged side view of a latching assembly of the prior art used to mount the printhead shown in FIG. 2
Figure 4:
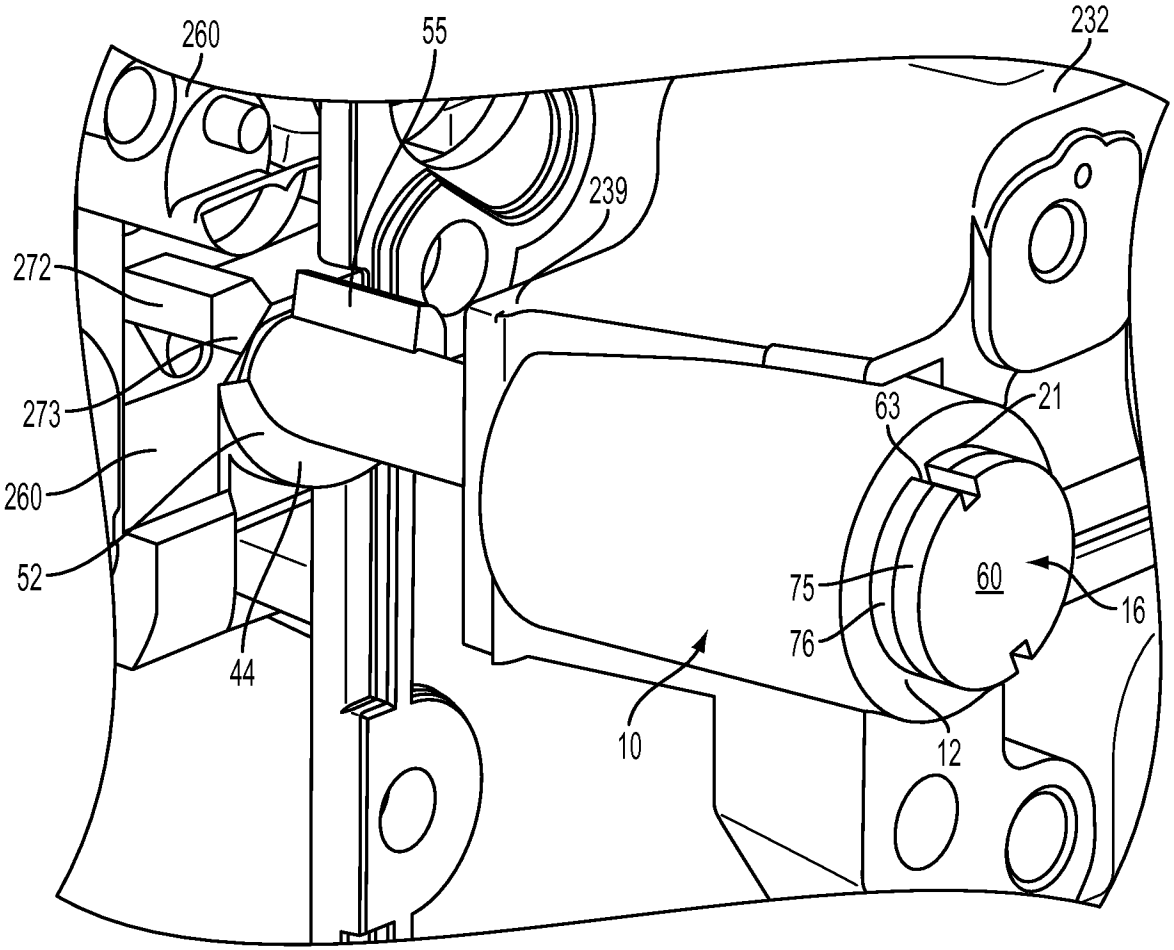
FIG. 4 is a cut-away view of a printhead mounted to a carriage plate assembly using a latching assembly according to the present disclosure.
Figure 5:
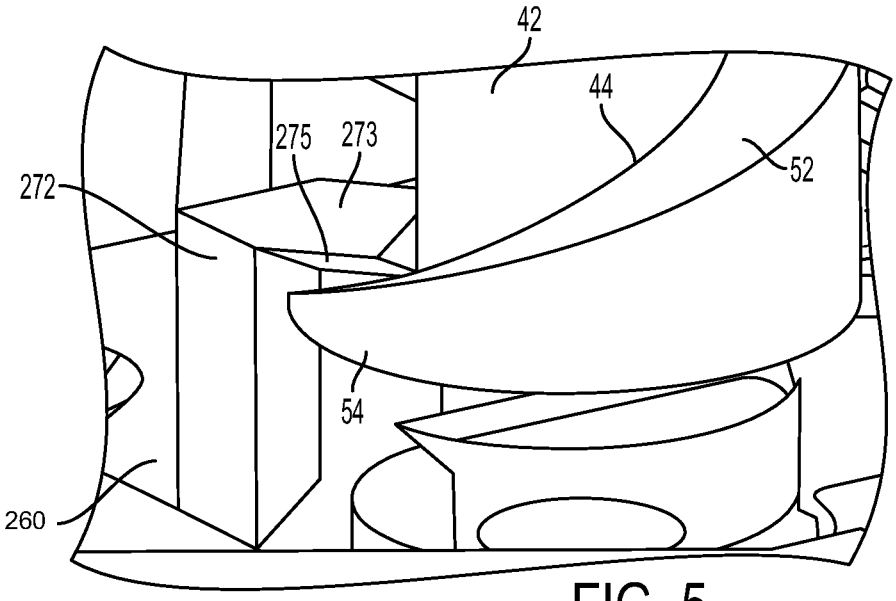
FIG. 5 is an enlarged perspective view a portion of the latching assembly shown in FIG. 4.
Figure 6:
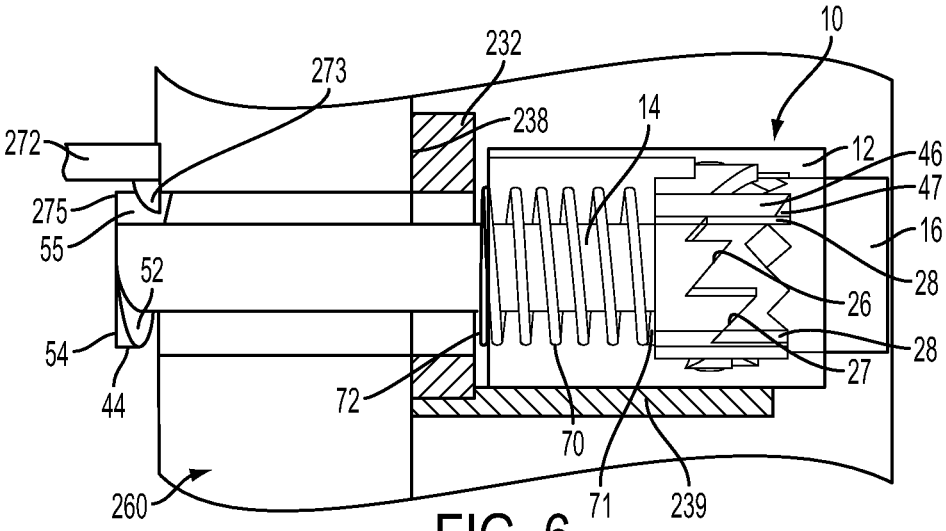
FIG. 6 side partial cut-away view of the latching assembly shown in FIG. 4.

Referring to FIGS. 4-6, a latching assembly 10 is shown for engaging or clamping a printhead 232 to a carrier plate assembly 260. (It is understood that intermediate components or surfaces may be provided between the printhead and carrier plate, as dictated by the particular printing machine). The latching assembly 10 is supported on the mounting flange 239 of the printhead. It is understood that a second latching assembly is situated at the opposite side of the printhead, in the same manner as the fasteners 250 in FIG. 1. In accordance with the illustrated embodiment, the latching assembly 10 includes a stationary barrel 12 that is held stationary with respect to the printhead 232 or mounting flange 239, an actuator member 14 that is supported by and interacts with the barrel, and a push button 16 that is operated by the person installing the printhead, as explained in more detail herein. In general terms, the operator uses the push button 16 for the two latching assemblies of the printhead to gradually clamp the printhead to the plate assembly. Unlike the fastener 250 of the prior art system (FIG. 1), the latching assembly 10 does not require any tools and each latching assembly 10 on the opposite sides of the printhead may be alternately tightened in step-wise fashion to ensure a solid, fluid-tight engagement between the printhead 232 and the mounting surface 238.

Figure 7:
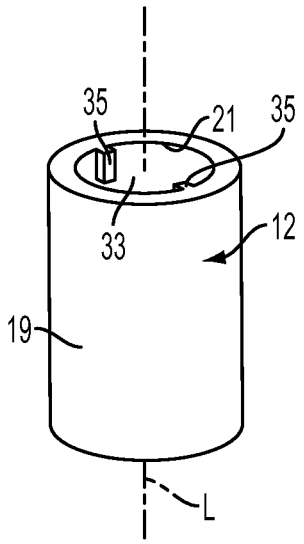
FIG. 7 is a side perspective view of a stationary barrel component of the latching assembly shown in FIG. 6.
Figure 8:
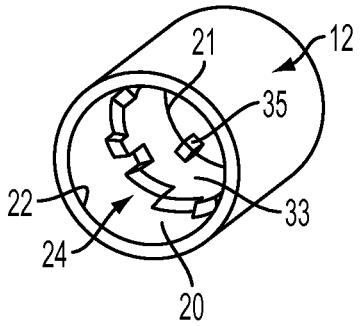
FIG. 8 is an end perspective view of the stationary barrel component shown in FIG. 7.
Figure 9:
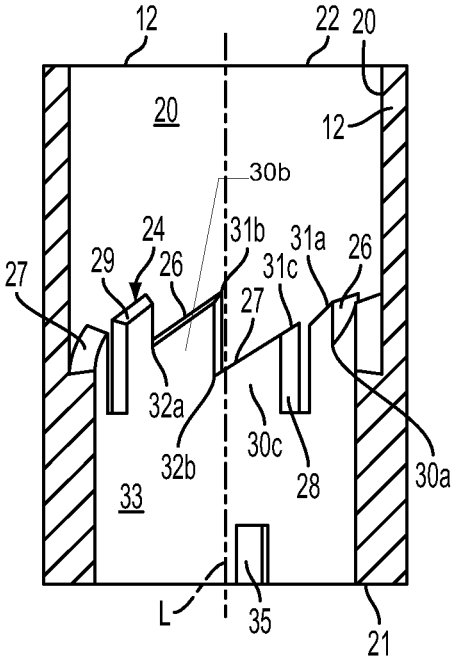
FIG. 9 is a side-cross-sectional view of the stationary barrel component shown in FIG. 7.

Referring more particularly to FIG. 6 and the detail component views of FIGS. 7-9, the stationary barrel 12 is an elongated body 19 that defines an interior cylindrical surface 20. The barrel is hollow so that the interior surface has a proximal opening 21, for access to the push button, and a distal opening 22, for passage of the actuator member. The latching assembly 10 is provided with a ratchet mechanism 24 between the stationary barrel 12 and the actuator member 14 that provides indexed translation of the actuator member relative to the barrel and relative to the printhead. The ratchet mechanism 24 incorporates two or more graduated surfaces, such as ramps 26 and 27, best seen in FIG. 9. In one embodiment, the graduated surfaces are formed by a sawtooth arrangement 33, or more specifically a number of teeth 30*a*, 30*b* and 30*c* extending radially inward from the interior surface 20 of the barrel. The teeth 30*a*, 30*b*, 30*c* include a corresponding crests 31*a*, 31*b*, 31*c* that are aligned or facing parallel to the longitudinal axis L of the barrel. In other words, while the teeth are radially offset inwardly from the circumferential surface 20, they are arranged to face the distal opening 21 of the barrel. The teeth 30*a* and 30*b* include corresponding roots 32*a* and 32*b*, while the tooth 30*c* includes a slot 28. As can be seen in FIG. 9, the roots 32*a* and 32*b*, and the slot 28 terminate successively closer to the proximal opening 22 of the barrel. Consequently, the graduated surfaces or ramps 26, 27 are also successively shallower relative to the proximal opening 22. This arrangement of graduated surfaces in the ratchet mechanism allows the actuator member 14 to be held at different depths within the stationary barrel.

Figure 10:
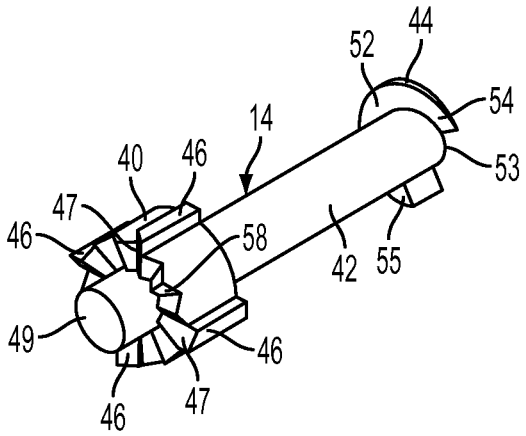
FIG. 10 is a perspective view of an actuator member of the latching assembly shown in FIG. 6.

The actuator member 14 includes an actuator head 40, an elongated shaft 42 extending from the head, and a latch element 44 situated at the end of the shaft 42, as shown in FIG. 10. The actuator head 40 includes a mating portion of the ratchet mechanism 24, namely the indexing element 46. In the illustrated embodiment, the indexing element 46 is a radially extending spline 46. The spline 46 is sized to nest or seat within the slot 28 in the stationary barrel. The spline 46 can also seat within each tooth root 32*a*, 32*b*, depending upon the position of the actuator member relative to the barrel. The spline 46 may incorporate a beveled surface 47 to seat against the ramp 26, 27 when the spline is situated within a corresponding root 32*a*, 32*b*. As shown in FIG. 10, the actuator head 40 includes four splines 46. The stationary barrel may include an equal number of sawtooth arrangements—i.e., four corresponding sets of teeth 30*a*-30*c*, roots 32*a*-32*b* and slot 28.

It can be appreciated that the ratchet mechanism 24 between the stationary barrel 12 and the actuator member 14 provides a mechanism for adjusting the axial or longitudinal position of the actuator member relative to the barrel. More pertinently, the ratchet mechanism permits stepwise adjustment of the position of the latch element 44 of the actuator member 14 relative to the printhead. As shown in FIGS. 4-6, the latch element 44 bears against a latching pin 273 of an alignment post 272 associated with the plate assembly 260. This stepwise adjustment draws the printhead toward the clamping surface 238 of the plate assembly. The clamping force applied between the printhead and plate assembly is achieved by the configuration of the latch element 44 in combination with a load transmission 70. Looking first at the latch element, the element includes a circumferential latch ramp 52 that extends at least partially around the circumference of the shaft 42, as seen most clearly in FIG. 10. The latch ramp 52 may be interrupted by a notch 53 that is used to align the latching mechanism 10 when a printhead is being installed. In one embodiment, the latching pin 273 projects from the guide post 272 towards the shaft 42 when the latching mechanism is positioned as shown in FIGS. 4-6. When the printhead is initially positioned facing the clamping surface 238, the shaft 42 of the actuator member 14 extends toward the alignment post 272. With the notch 53 of the latch element 44 lined up with the guide pin 273, the actuator member can be placed in its clamping position, as best depicted in FIG. 4. In this position, the latch ramp 52 is aligned to contact a latching surface 275 of the latching pin 273. The latching surface 275 may define a surface that is complementary to the circumferential ramp surface.

It can be appreciated that as the latch ramp 52 of the actuator member is rotated relative to the stationary barrel 12 and the plate assembly 260, different portions of the ramp contact the latching surface 275. When the printhead is initially positioned against the plate assembly, the thinner end 54 of the latch ramp is adjacent the latching surface 275, as shown in FIGS. 4-5. As the actuator member 14 is rotated more and more of the latch ramp is brought into contact with the latching surface 275 until the thicker end 55 is in contact with the latching surface. This action of the latch ramp attempts to draw the actuator member 14 toward the latching surface 275 of the plate assembly. The latching apparatus 10 thus includes a load transmission element 70 disposed between the actuator head 40 and the printhead 232, or the mounting flange 239 of the printhead, as shown in FIG. 6. As the rotating latch ramp translates the actuator member, the actuator head 40 bears against the proximal end 71 of the load transmission element 70, which in the illustrated embodiment is a compression spring. Translation of the actuator head thus applies a force to the spring 70 which is conveyed through the distal end 72 to the printhead 232 to push the printhead toward the clamping surface 238.

The orientation of the latch ramp 52 relative to the latching pin 273 and latching surface 275 is correlated to the orientation of the ratchet mechanism 24. Thus, when the printhead is initially positioned and the thinner end 54 of the latch ramp is adjacent the latching surface, the radial splines 46 of the actuator head 40 are disposed within the slots 28. The load transmission spring 70 tends to push the actuator head 40 toward the proximal opening 21 in the stationary barrel, so the actuator member 14 is held in the "un-latched" position shown in FIGS. 4-6. When the actuator head is advanced until the splines are within the roots 32*b* the latch ramp has rotated to the position shown in FIG. 13 in which the middle portion of the latch ramp is adjacent the latching surface 275. Finally, when the actuator head has rotated further and the splines 46 are nested within the roots 32*a*, as shown in FIG. 14, the thicker end 55 of the latch ramp is nearer the latching surface and the actuator member 14 is in its "latched" position. It can be appreciated that in certain embodiments the ramp 44 may not be rotated entirely to the thicker end 55 when the printhead is tightly clamped to the plate assembly.

Each of these discrete positions of the actuator member 14 and latch ramp 52 allows the operator to sequentially tighten the printhead 232 to the plate assembly 260. Moreover, the two latching apparatuses 10 at the opposite sides of the printhead may be alternately adjusted, or may be simultaneously actuated to ensure a fluid-tight connection between printhead and plate assembly. In order to simplify and facilitate this discrete adjustment capability, the latching assembly disclosed herein contemplates the use of the push button 16 and a cam mechanism between the push button and actuator member.

The cam mechanism between these two components includes a cam element 58 formed on the actuator head 40. The actuator head further includes a guide post 49 onto which the push-button 16 is mounted. The push-button thus includes a cavity 62 defined on a distal face 61 of the push-button which fits over the guide post 49. The opposite proximal face 60 of the push-button is externally accessible when the push-button is mounted within the stationary barrel 12, as shown in FIG. 5. The proximal end of the push-button further includes a pair of opposite grooves 63 that are configured to fit over corresponding radial ribs 35 (FIG. 9) defined in the stationary barrel 12. The grooves 63 prevent the push-button from exiting the proximal opening 21 of the barrel while allowing the push-button to translate freely within the barrel. The grooves and ribs thus ensure that the push-button remains in contact with the actuator head.

Figure 11:
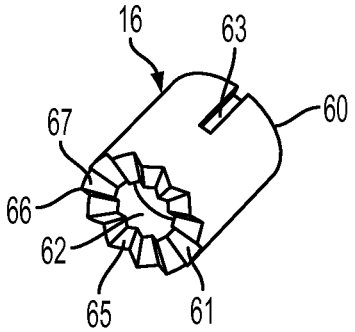
FIG. 11 is an end perspective view of a push-button component of the latching assembly shown in FIG. 6.
Figure 12:
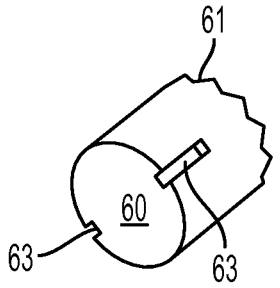
FIG. 12 is a perspective view of an opposite end of the push-button component of the latching assembly shown in FIG. 11.

The cam mechanism further includes a cam surface 65 on the distal face 61 of the push-button. The cam surface 65 is adapted to engage the cam element 58 on the actuator head when the components are assembled within the barrel, as shown in FIG. 6. It can be seen that the cam mechanism formed by the element 58 and surface 65 is radially inboard of the indexing element or radial splines 46. Likewise, the cam mechanism is radially inboard of the ratchet mechanism 24 on the interior surface 20 of the barrel 12 so that the elements of the cam mechanism do not engage or interfere with the indexing operation between the actuator member 14 and the stationary barrel 12. As can be seen in FIGS. 10 and 11 the cam mechanism includes a series of ridges and valleys, such as the ridges 66 and valleys 67. The ridges and valleys are calibrated between the actuator head and push-button so that when the push-button is pressed against the actuator member the cam mechanism imparts a slight rotation to the actuator head and actuator member. The spring 70 also applies an opposite force that helps impart rotation to the actuator head as the actuator head moves proximally under the spring force. This slight rotation is enough movement to shift the radial splines 46 a sufficient angular amount to traverse a tooth crest 31*a*, 31*b*, 31*b*.

Figure 13:
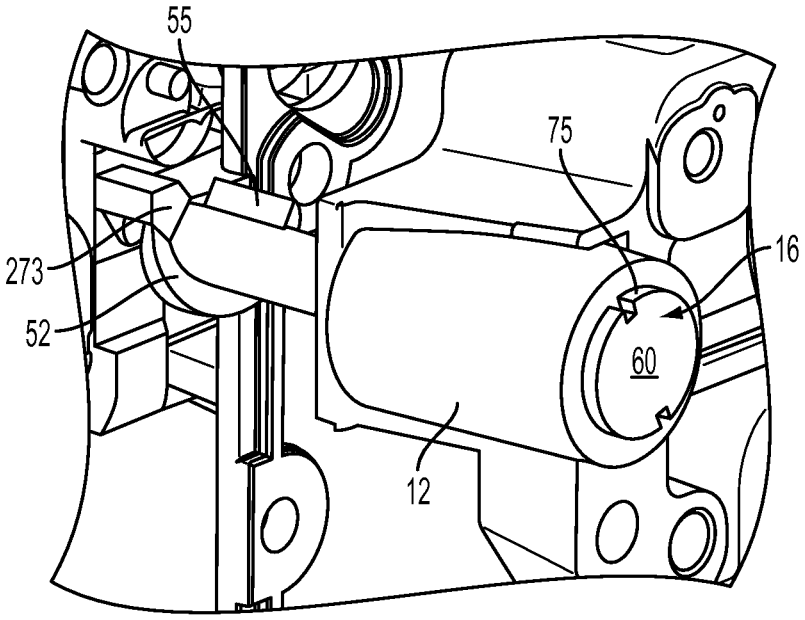
FIG. 13 is an enlarged side perspective view of the latching assembly shown in FIG. 4 with the latching assembly in an intermediate position.
Figure 14:
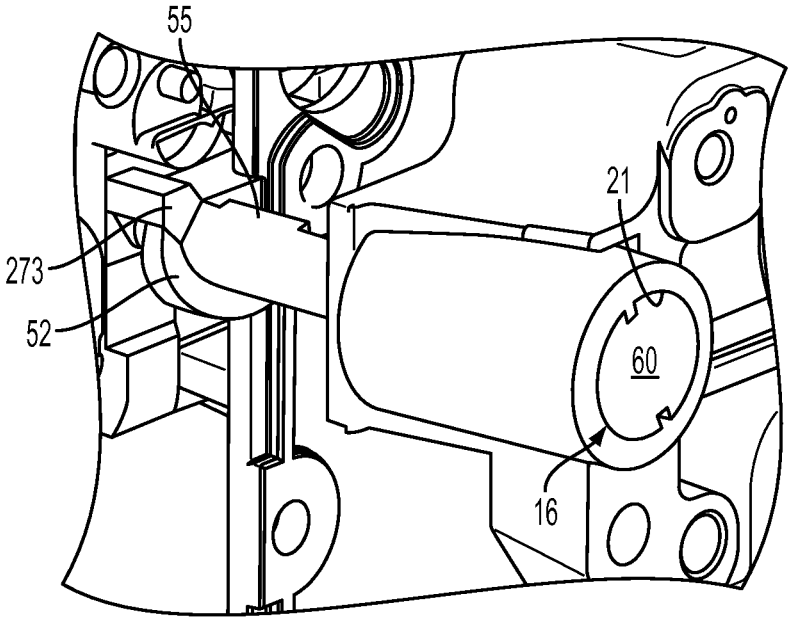
FIG. 14 is an enlarged side perspective view of the latching assembly shown in FIG. 4 with the latching assembly in a latched position.

The cam mechanism 65 between the push-button and actuator member allows the operator to sequentially rotate the latch element 44 from the unlatched position shown in FIG. 5 to the intermediate position shown in FIG. 13, and finally to the latched position shown in FIG. 14. In the initial unlatched position, the radial splines 46 of the actuator head reside within the slots 28 in the stationary barrel 12. In this position the loose end 54 of the latch element 44 is aligned with the latching pin 273 of the plate assembly 260 and the push-button 16 projects out from the proximal end of the barrel to its full extent. The position of the push-button thus serves as an indicator of the location of the latch element, and more particularly that the latch element is not fully engaged to the plate assembly. With the printhead 232 positioned against the plate assembly, the two latching mechanisms will be in their unlatched position.

The operator then depresses one or both push-buttons. This movement thus pushes the actuator member down within the stationary barrel which moves the radial splines 46 out of the slots 28. As the splines move clear of the slots, the cam mechanism between the push-button and actuator head cause the actuator member to rotate slightly as the ridges and valleys move to interdigitate. This slight rotation allows the radial splines to move over the immediate tooth crest 31*c*. When the push-button is released, the load transmission element or spring 70 pushes the actuator head proximally so that the radial splines engage the graduated surface or ramp 27 of the ratchet mechanism 24 in the interior surface 20 of the barrel. The continued pressure from the spring causes the radial splines 46 to seat within the tooth root 32*b*. With the actuator head so seated the actuator member and latch element 44 is in the intermediate position shown in FIG. 13. In this position the latch ramp 52 is rotated relative to the latching surface 275 so that the latch ramp contacts at an intermediate position between the two ends 54, 55 of the ramp. This intermediate position draws the printhead closer to the clamping surface 238 but the printhead is still not fully mounted. It is contemplated that the operator may alternate between the push-buttons of the two latching mechanisms 10.

The operator then depresses the push-button a second time. This movement dislodges the actuator head from the tooth root 32*b*, moves the radial splines 46 clear of the second tooth crest 31*b* and slightly rotates the actuator head to line up with the second ramp 26. Again, the biasing force of the spring 70 pushes the radial splines into the second tooth root 32*a*. As the radial splines ride down the graduated ramp 26 the actuator member is rotated, which in turn rotates the latching element 44 until the thicker end 55 of the latch ramp 52 engages the latching surface 275 in the position shown in FIG. 14. In this position the printhead is now fully engaged to the plate assembly and the process of mounting a new printhead is complete.

When it is necessary to replace the printhead the same operation is repeated. In particular, the push-button 16 is depressed which advances the actuator head past the tooth crest 31*a*. The cam mechanism 58 between the push-button and actuator head causes the actuator member to rotate slightly until the radial splines 46 are aligned with the ramp 29. This ramp feeds the radial splines into the slots 28 when the spring 70 pushes the actuator member 14 back. The latch element 44 is now aligned in its unlatched position with the notch 53 lined up with the guide pin 273. The latching mechanism 10 can now be removed from the plate assembly together with the printhead 232.

As shown in FIG. 9, the amount of longitudinal travel required for the actuator member to move from position to position decreases as the actuator member approaches the latched position. In other words, the distance that the radial splines 46 travel to exit the slots 28 is greater than the distance the splines travel to exit the tooth root 32*b*. Likewise, the travel distance is shorter from root 32*a* compared to root 32*b*. It can be appreciated that the shorter successive travel is desirable because the latch ramp 52 is gradually rotating to draw the printhead 242 and plate assembly 260 closer together. With each successive positioning of the actuator member and latch element the spacing between the printhead and plate assembly decreases which is thus reflected in the shorter travel distance of the radial splines to reach the next position.

It can also be appreciated that the movement of the push-button 16 is decreased at successive positions of the actuator member 14. As shown in comparing FIGS. 5, 13 and 14, it can be seen that in the initial unlatched position the push-button is prominent from the proximal opening 21 of the stationary barrel 12. In the intermediate position shown in FIG. 13, the push-button still projects from the end of the barrel but by a lesser amount than in FIG. 5. Finally, when the latching mechanism 10 is in the latched position shown in FIG. 14, the push-button may be flush with or even slightly recessed within the proximal opening 21 of the stationary barrel. The degree of prominence of the push-button relative to the barrel provides a visual indication of the position of the latch mechanism 10. In order to enhance this visual indication, the periphery of the push-button 16 may be provided with two circumferential color bands 75, 76, each with a different color. The bands are axially offset along the push button so that when the push-button is in its initial unlatched position, both color bands are visible, as shown in FIG. 5. When the push-button is in the intermediate position of FIG. 13, only one color band 75 is visible. When the push-button is in the fully latched position of FIG. 14, no color bands are visible, which provides a clear visible indication that the latching mechanism is fully latched.

In the illustrated embodiment, the ratchet mechanism 24 generates three discrete positions for the actuator member 14, and consequently the latch element 44, as represented by the slot 28 and two tooth roots 32*a*, 32*b*. It is understood, however, that the number of intermediate positions may be modified. For instance, additional intermediate positions may be introduced by adding additional teeth to the teeth 30*a*, 30*b*, 30*c* shown in FIG. 9. The graduated surfaces or ramps 26, 27, 29 may be abbreviated to make room for the additional teeth with the corresponding ramps and tooth roots.

It is contemplated that the components of the latching mechanism 10 may be formed from a high strength plastic material. The barrel 12, actuator member 14 and push-button 16 may be easily formed in an injection molding process. In the illustrated embodiment, the ratchet mechanism 24 incorporates the graduated surfaces and teeth on the interior cylindrical surface 20 of the barrel 14, and the radial splines 46 on the actuator head. However, the arrangement of these components may be reversed, with the radial splines projecting inward from the interior surface 20 and the graduated surfaces and teeth formed on the outer circumference of the actuator head. With respect to the cam mechanism 58, 65 between the push-button and the actuator head, the illustrated embodiment incorporates a series of twelve ridges and valleys that impart a slight rotation when the two mechanisms engage. Alternatively, the cam mechanism may incorporate a continuously ramped surface, similar to the latch ramp 52, as part of one of the cam mechanisms 58, 65, while the other of the cam mechanisms includes a follower element, similar to the radial splines 46. With this modification, when the push-button 16 is pressed against the actuator head 40 the follower slides along the ramped surface, hereby imparting a rotation to the actuator head (since the push-button is constrained against rotation).

The load transmission element or spring 70 is calibrated to permit a user to manually depress the push button 16 to actuate the latching mechanism. It can be appreciated that a spring that is too stiff will make it difficult for the user to overcome the spring force. On the other hand, the spring must have sufficient stiffness to firmly press the printhead 232 against the plate assembly 260 once the latching assembly is fully latched. It is contemplated that the load transmission element 70 may incorporate a single spring, as in the illustrated embodiment, or may employ multiple co-axial springs. In this latter approach, one spring may be configured to be contacted only after the actuator mechanism and latch element has moved to an intermediate position, such as the position shown in FIG. 14. The additional spring would increase the clamping force generated by the latching assembly when the assembly is fully latched. It is also contemplated that an external lever may be provided on the front of the barrel or printhead that can be used as a fulcrum to depress the lever. In this instance, the position of the lever may serve as an indicator of position of the latch mechanism.

As explained above, when the actuator head 40 is indexed from position to position, the load transmission element or spring 70 pushes the actuator head back toward the proximal opening 21 of the stationary barrel in order to seat the radial splines 46 in the slot 28 or a particular tooth root 32*a*, 32*b*. This action of the spring thus has a tendency to push the printhead 232 away from the plate assembly 260. The printhead 232 may be configured to provide a gripping feature adjacent the mounting flange 239 supporting the latching mechanism 10 that allows the operator to grasp the printhead while leaving the operator's thumb free to depress the push-button. Grasping the printhead can resist this tendency of the printhead to move backward as the latching mechanism is indexed from the unlatched to the latched position.

The latching mechanism may be permanently affixed to each side of the printhead. Thus, the stationary barrel 12 may be integrally formed as part of the body of the printhead, or may be separately fixed to the mounting flange 239. Alternatively, the latching mechanism 10 may be removably mounted to the flange 239 so that the latching mechanism may be removed from a printhead being replaced and reused with a new printhead. In this case, the mounting flange 239 and stationary barrel 12 may incorporate a releasable engagement mechanism that fixes the barrel to the flange and holds the barrel stationary so that it cannot rotate or translate while the actuator member 14 and push-button 16 are being operated. For instance, the mounting flange and barrel may be configured to form a snap-fit engagement between the components.

It is further contemplated that the latching surface 275 of the plate assembly 260 may be incorporated into another surface of the plate assembly other than the alignment post 272. In addition, the plate assembly may incorporate other features to align and orient the latching mechanism, and particularly to align with the notch 53 in the latching element 44.

Figure 15:
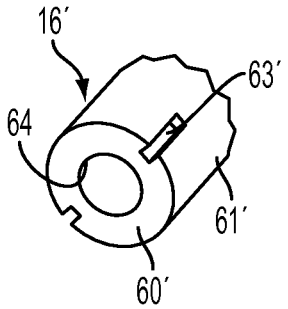
FIG. 15 is an end perspective view of a modified push-button component for an alternative latching mechanism disclosed herein.
Figure 16:
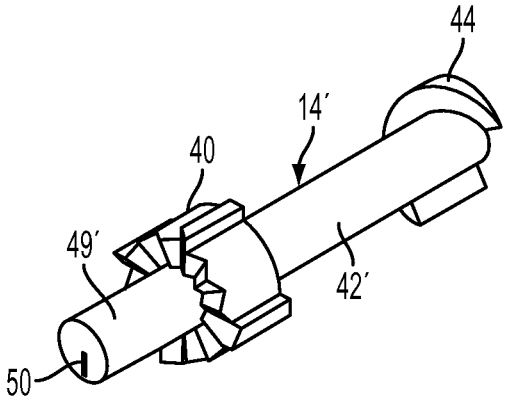
FIG. 16 is a perspective view of a modified actuator member for the alternative latching mechanism disclosed herein.

In an alternative latching mechanism the actuator member is configured to indicate the position of the latching mechanism. As shown in FIG. 16, the modified actuator member 14' may incorporate an indicator 50 at the end of the guide post 49'. As with the prior actuator member, the member 14' has a shaft 42', a latch element 44 and actuator head 40, and is configured so that the push button 16' (FIG. 15) is mounted on the guide post 49'. As with the prior push button, push button 16' has a proximal face 60', a distal face 61' and grooves 63' that are configured to fit over corresponding radial ribs in the stationary barrel 12. However, in this alternative embodiment the push button defines an opening 64 through which the end of the guide post, and therefore the indicator 50, is visible. The opening 64 is in communication with the cavity 62 (FIG. 11) within which the guide post of the actuator mechanism is received. The actuator member 16' is further configured to be disposed within the stationary barrel 12. The actuator member may be further modified so that the guide post 49' extends farther outward from the actuator head 40 than in the prior embodiment.

Figure 17:
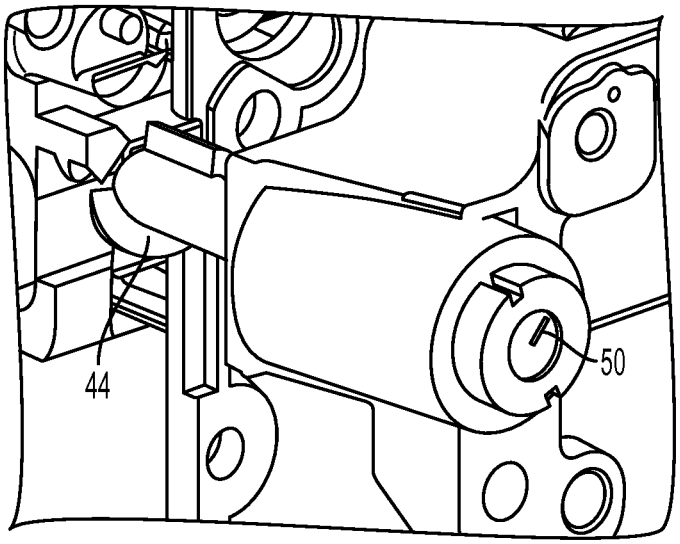
FIG. 17 is a perspective view of the alternative latching mechanism in an unlatched orientation.
Figure 18:
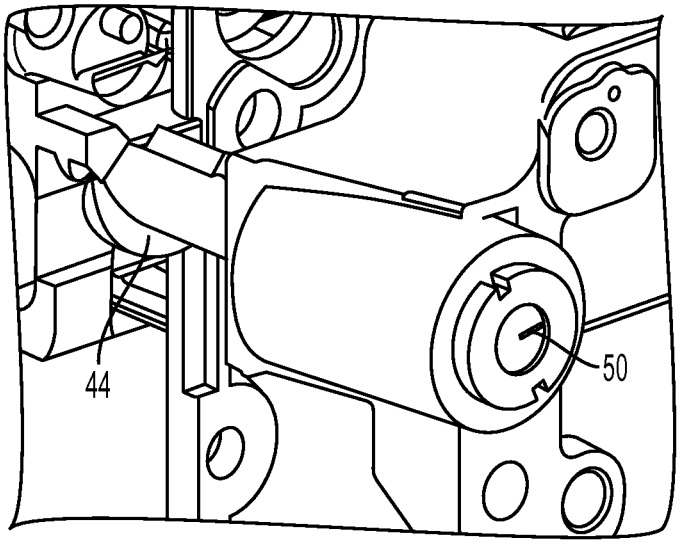
FIG. 18 is a perspective view of the alternative latching mechanism in an intermediate position.
Figure 19:
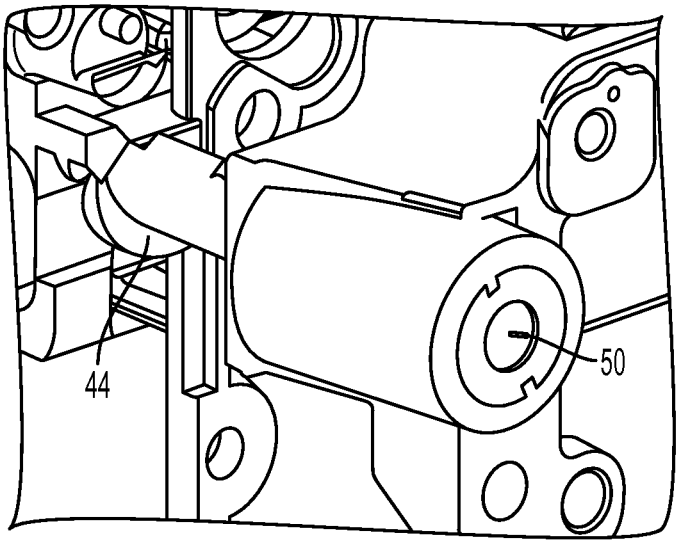
FIG. 19 is a perspective view of the alternative latching mechanism in a latched position.

As shown in FIGS. 17-19, the indicator 50 at the end of the actuator member 14' provides a clear indication of the amount of rotation of the actuator member, and consequently the degree of engagement of the latch element 44 with the latching surface 275. In one embodiment the indicator 50 is a radial line, although other readily visible indicia are contemplated. In the initial or free position of the latch the indicator 50 has the position shown in FIG. 17. When the push button is depressed to advance the actuator member, the indicator is rotated to the position shown in FIG. 18. After the push button is depressed a second time the indicator is moved to the final or latched position shown in FIG. 19. The stationary barrel or push button may be provided with a stationary indicator aligned with the indicator 50 in the free or unlatched position of FIG. 17. The stationary indicator can then provide a reference point to accentuate the amount of rotation of the indicator 50 through the different stages of actuation.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the claims that follow.

What is claimed is:

1. A latching assembly for mounting a printhead to a plate assembly of a printing machine comprising:

a hollow cylindrical barrel attached to the printhead, said barrel defining an interior cylindrical surface, a distal opening, a proximal opening, and a longitudinal axis extending from said distal opening to said proximal opening;

an actuator member having an actuator head disposed for translation and rotation within said barrel along said longitudinal axis, an elongated shaft extending from said actuator head through said distal opening, and a latch element disposed at an end of said shaft opposite said actuator head, said latch element including a circumferential latch element configured to engage a catch surface on the plate assembly upon rotation of said actuator member;

a ratchet mechanism defined between said actuator head and said interior cylindrical surface, said ratchet mechanism including at least two graduated surfaces and at least one indexing element configured to slidably engage one of said at least two graduated surfaces, said ratchet mechanism configured to advance said at least one indexing element from one graduated surface to another graduated surface of said at least two graduated surfaces upon rotation of said actuator member relative to said barrel to thereby translate said actuator member longitudinally relative to said barrel;

a push button disposed for translation within said barrel and arranged to be manually depressed at said proximal opening, said push button having a proximal face configured to be manually depressed and an opposite distal face; and a cam mechanism defined between said distal face of said push button and said actuator member, said cam mechanism configured to rotate said actuator member relative to said barrel when said distal face of said push button bears against said actuator member.

2. The latching assembly of claim 1, further comprising a load transmission element disposed between the printhead and said actuator head configured to bias said actuator head toward said proximal opening of said barrel.

3. The latching assembly of claim 2, wherein said load transmission element is a compression spring concentrically disposed about said elongated shaft of said actuator member and at least partially within said barrel.

4. The latching assembly of claim 1, wherein said ratchet mechanism further includes:

at least one tooth having a crest arranged parallel to said longitudinal axis of said barrel, said crest flanked by circumferentially opposite roots, wherein two of said at least two graduated surfaces are opposite ramps of said at least one tooth, said opposite ramps extending from said crest to a corresponding opposite root, one of said opposite roots being closer to said proximal opening of said barrel than the other of said opposite roots, wherein said at least one indexing element is at least one radial spline sized and arranged to be selectively received in each of said opposite roots and configured to slide along said opposite ramps into one of said opposite roots.

5. The latching assembly of claim 4, wherein:

said at least one tooth is defined on and projects radially inward from said interior surface of said barrel; and said at least one radial spline projects radially outward from said actuator head to contact said at least one tooth.

6. The latching assembly of claim 1, wherein said cam mechanism includes opposing circumferentially ridged surfaces defined between said distal face of said push button and said actuator member.

7. The latching assembly of claim 6, wherein said actuator head includes one of said opposing circumferentially ridged surfaces.

8. The latching assembly of claim 5, wherein said cam mechanism includes opposing circumferentially ridged surfaces defined between said distal face of said push button and said actuator head of said actuator member, said actuator head having one of said opposing circumferentially ridged surfaces, said circumferentially ridged surface of said actuator head disposed radially inboard of said at least one radial spline so that said circumferentially ridged surface of said actuator head does not contact said at least one tooth.

9. The latching assembly of claim 1, further comprising a groove and rib arrangement defined between said barrel and said push button, said groove and rib arrangement configured to permit only translation of said push button along said longitudinal axis relative to said barrel.

10. The latching assembly of claim 9, wherein said groove and rib arrangement is defined at said proximal opening and is arranged to prevent removal of said push button through said proximal opening.

11. The latching assembly of claim 4, wherein said at least one tooth is at least one sawtooth arrangement including at least two teeth defined on said interior cylindrical surface, said at least two teeth include at least three roots, wherein two of said at least three roots are said opposite roots, wherein a circumferentially successive root of said opposite roots is closer to said proximal opening than a circumferentially preceding root of said opposite roots.

12. The latching assembly of claim 11, wherein one of said three roots that is closest to said proximal opening defines a slot, and said at least one radial spline is configured to nest within said slot.

13. The latching assembly of claim 1, wherein said circumferential latch element of said actuator member includes a circumferential ramp.

14. The latching assembly of claim 13, wherein said circumferential latch element further includes an indexing notch interrupting said circumferential ramp.

15. The latching assembly of claim 13, wherein said circumferential ramp is configured to provide a thinner end and a relatively thicker end, said thinner end corresponding to a position in which the latching assembly is partially latched to the plate assembly and said thicker end corresponding to a position in which the latching assembly is fully latched to the plate assembly.

16. The latching assembly of claim 13, wherein said circumferential ramp is configured to draw said actuator member toward the plate assembly upon rotation of said actuator member in one direction.

17. The latching assembly of claim 1, wherein:

said push button defines a cavity facing said distal opening of said barrel; and said actuator member includes a guide post projecting from said actuator head and arranged to be slidably disposed within said cavity in said push button.

18. The latching assembly of claim 17, wherein:

said push button defines a proximal opening in communication with said cavity; and said guide post of said actuator member includes indicia visible through said proximal opening in said push button, said indicia operable to indicate rotation of said actuator member relative to said barrel.

19. The latching assembly of claim 1, wherein said push button includes indicia indicative of the amount of translation of the push button relative to the barrel.

20. The latching assembly of claim 19, wherein the indicia includes at least two differently colored circumferential bands axially displaced along said push button, said bands arranged so that all bands are visible in a first position of said push button before it is depressed and so that one of said bands is hidden from view each time the push button is depressed.

21. A latching assembly for mounting a printhead to a plate assembly of a printing machine comprising:

a hollow cylindrical barrel attached to the printhead, said barrel defining a cylindrical surface and a longitudinal axis;

an actuator member having an actuator head disposed for translation and rotation relative to said barrel along said longitudinal axis, and a latch element connected to said actuator head and including a circumferential element configured to engage a catch surface on the plate assembly upon rotation of said actuator member;

a ratchet mechanism defined between said actuator head and said cylindrical surface of said barrel, said ratchet mechanism configured to hold said actuator head at different longitudinal positions relative to said barrel upon rotation of said actuator head about said longitudinal axis relative to said barrel;

a push button carried by said barrel for translation along said longitudinal axis, said push button having a proximal face configured to be manually depressed and an opposite distal face; and a cam mechanism defined between said distal face of said push button and said actuator member, said cam mechanism configured to rotate said actuator member relative to said barrel when said proximal face of said push button is manually depressed.

* * * * *